United States Patent [19]

Durand

[11] Patent Number: 4,624,524

[45] **Date of Patent: * Nov. 25, 1986**

[54] BASE REDUNDANT TERMINAL

[75] Inventor: Remie P. Durand, Fraser, Mich.

[73] Assignee: Chrysler Motors Corporation, Highland Park, Mich.

[ * ] Notice: The portion of the term of this patent subsequent to Jun. 3, 2003 has been disclaimed.

[21] Appl. No.: 752,411

[22] Filed: Jul. 3, 1985

[51] Int. Cl.[4] ..... H01R 13/502

[52] U.S. Cl. ..... 339/176 L; 339/59 L; 339/191 L; 339/217 S

[58] Field of Search ..... 339/176 L, 177 L, 191 L, 339/182 L, 195 L, 91 L, 59 L, 61 R, 61 M, 61 L, 128, 217 S, 144 R, 145 R

[56] References Cited

U.S. PATENT DOCUMENTS

| | | | |
|---|---|---|---|
| 3,017,599 | 1/1962 | Loesch | 339/176 L |
| 3,027,537 | 3/1962 | Hess et al. | 339/191 L |
| 3,781,755 | 12/1973 | Pitacco | 339/176 L |
| 3,936,131 | 2/1976 | Durand | 339/128 |
| 3,999,095 | 12/1976 | Pearce, Jr. et al. | 313/318 |
| 4,076,359 | 2/1978 | Brownlee | 339/32 R |
| 4,114,972 | 9/1978 | Kraus et al. | 339/65 |
| 4,160,887 | 7/1979 | van Buren, Jr. | 200/61.62 |
| 4,168,411 | 9/1979 | Peck | 200/61.62 |
| 4,181,390 | 1/1980 | Aizawa | 339/176 L |
| 4,225,906 | 9/1980 | Gulliksen et al. | 362/254 |
| 4,365,396 | 12/1982 | Baba et al. | 339/176 L |
| 4,482,944 | 11/1984 | Roossine et al. | 362/418 |

*Primary Examiner*—Gil Weidenfeld
*Assistant Examiner*—Paula A. Austin
*Attorney, Agent, or Firm*—Mark P. Calcaterra

[57] ABSTRACT

A twisted tang formed by notching the base of a snap-in terminal, the tang directed toward the interior of the terminal to urge contact with misaligned filament wires of a wedge base bulb.

2 Claims, 18 Drawing Figures

Fig-4
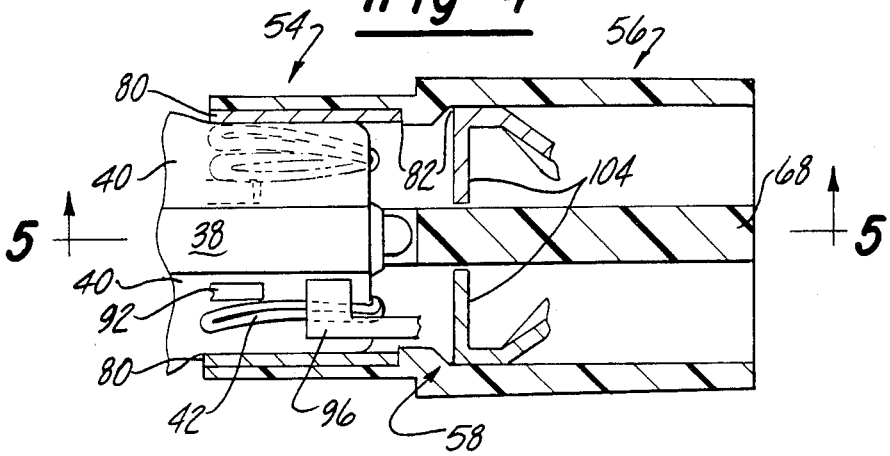
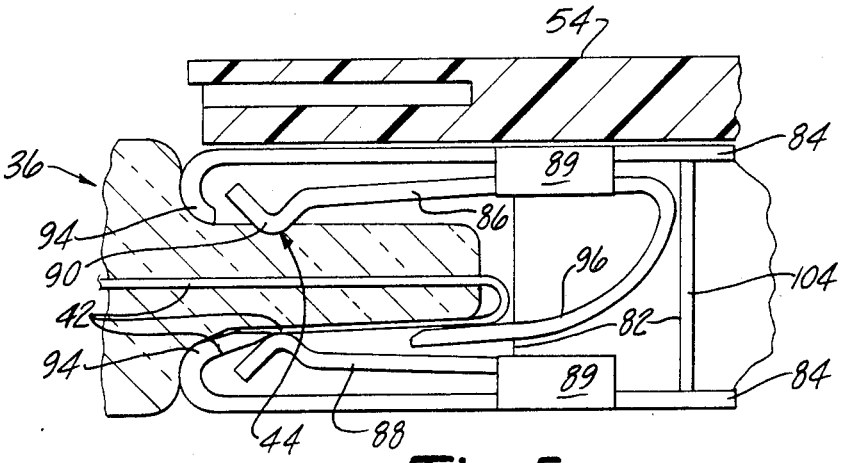
Fig-5
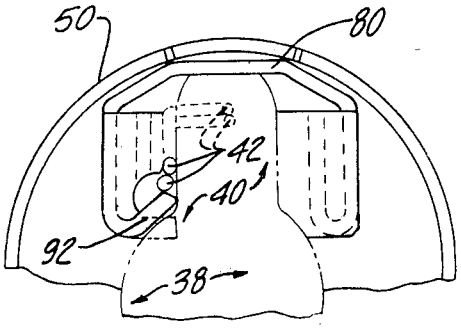
Fig-6

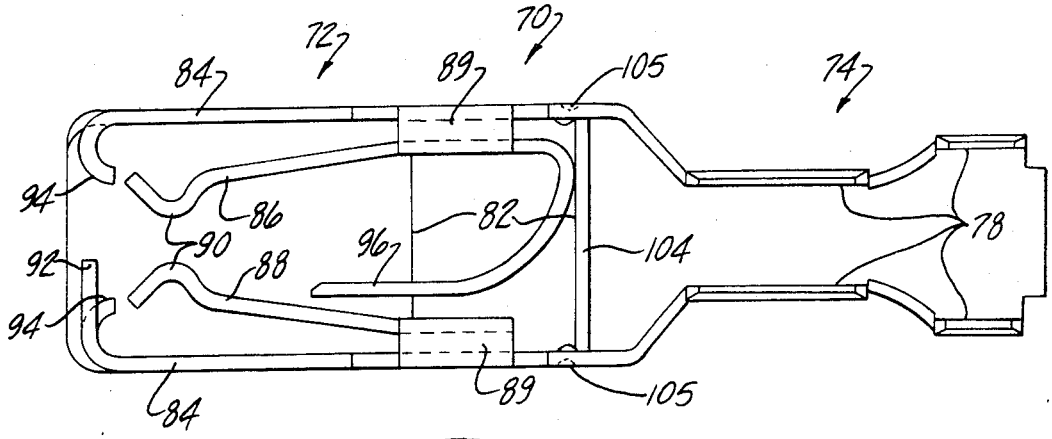
Fig-7
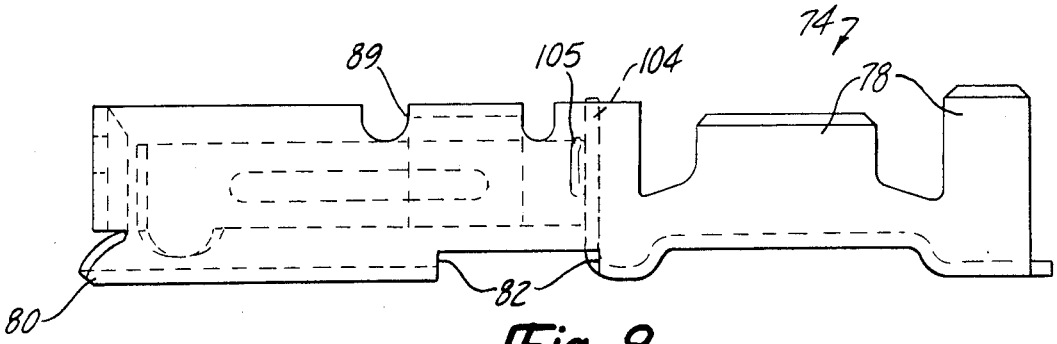
Fig-8
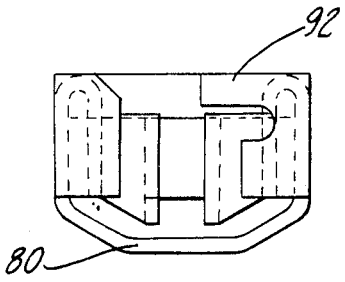
Fig-9
Fig-10
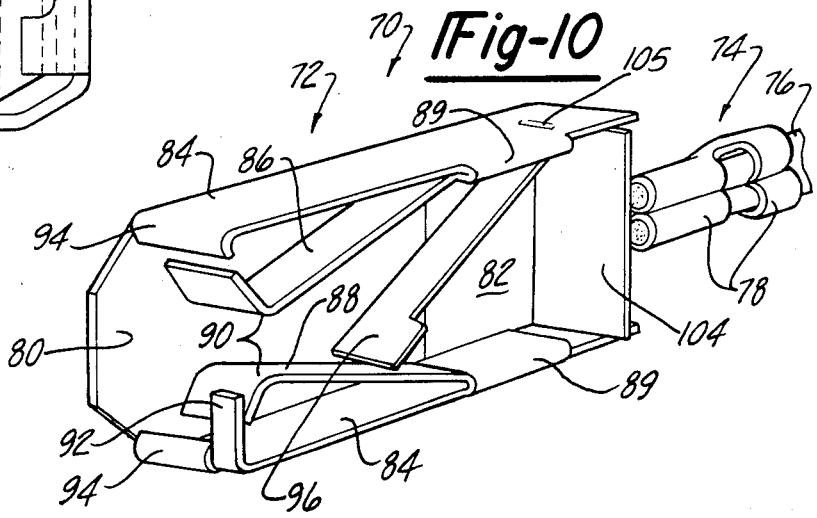

BASE REDUNDANT TERMINAL

The portion of the term of this patent subsequent to the term of the patent issued from now allowed U.S. application Ser. No. 06/752,265 has been disclaimed.

BACKGROUND AND SUMMARY OF THE INVENTION

This invention relates to a snap-in lamp terminal for wedge-base bulbs used in an assembly with a wedge-base bulb socket. The invention improves electrical contact between the bulb and terminal and allows the terminal to be used in a socket housing made from soft vinyl material.

Components of the socket assembly are the wedge-base bulb, the snap-in lamp terminal, the snap-in tubular socket or, when situations demand, the vinyl socket housing. Their descriptions follow.

The wedge-base bulb is made up of a bulbular evacuated chamber fused to a wedge-base. The wedge-base configuration includes a raised centrally located cylindrical vent tube running along the central longitudinal axis of the bulb. The vent tube is bound on both sides by laterally extended side wings. The bulb also has a lamp filament wire which extends through and out the bottom end of the side wings in such a manner that on either side of the vent tube there is only one end of the filament wire. Each end is bent or looped back upon itself and reentrant in and sealed in the wedge-base. This looped formation is then bent back onto the wedge-base extending towards the bulbular evacuated chamber, one looped wire on the front of the wedge-base, the other on the back side. The wedge base also has two concave detent troughs extending transversely to the longitudinal axis of the bulb. Each detent trough is located on the opposite side of the side wing where the filament wire extends. Thus, on one side of the wedge-base on the side wing, left of the vent tube, the filament wire loop extends toward the bulbular evacuated chamber. On the side wing to the right of the vent tube is the transversely extending detent trough.

The next component of the socket assembly is the snap-in lamp terminal. The snap-in lamp terminal is made up of a channel shaped body, extending longitudinally, surrounding contact arms attached to each side. The front entry-way of the terminal has a wire guide protuding from one side of the channel body. The rear of the terminal has a mold fill retention wall to allow the terminal to be molded directly into a vinyl socket. This wall is only necessary when a vinyl socket assembly is made by injecting vinyl material into a mold with the terminals present.

Located inside the terminal channel body is a redundant contact terminal means (to be explained later).

The socket assembly designed for the wedge-base bulb then consists of a pair of snap-in lamp terminals held either by a molded vinyl lamp socket or a hard tubular snap-in lamp socket. The tubular socket has an interior rib dividing the interior of the socket into two longitudinally extending channels. These channels accept the snap-in lamp terminals and hold them in place by a cantilevered wedge clamp running along the outside longitudinal axis of the tubular socket. Upon insertion of the terminals, the socket assembly, now complete, is ready for the installation of the wedge-base bulb.

The wedge-base bulb is axially inserted into the front of the socket assembly and makes electrical contact with the terminals which allows for energization of the bulb. This electrical contact is accomplished through the surface contact of the bulb's filament wire and the terminal's contact arm. Specifically, upon installation of the bulb, the wedge base is squeezed by the two contact arms of the terminal. One contact arm exerts spring pressure on the side wing of the bulb where it interlocks with the detent trough. The other contact arm exerts spring pressure on the opposite side of the same side wing where it makes electrical contact with the bulb's filament wire. This electrical contact is made only if the filament wire is in its proper mating position. That proper position is between the exterior edge of the side wing and the edge of the central vent tube where the wire extends towards the bulbular evacuated chamber parallel with the longitudinal axis of the bulb.

Often, the filament wire is not in this correct mating position due to the manufacturing and handling process. When such occurs, the wedge-base bulb must be manually removed from the socket and the filament wires manually straightened to provide proper electrical contact upon re-installation of the bulb.

To provide for better filament wire positioning, not through costly manual means, but by utilizing an alignment device upon insertion of the bulb, a wire guide means was introduced into previous terminal designs. This wire guide means protrudes out toward the center of the terminal channel and wipes near the surface of the vent tube. This wiping action was designed to realign a filament wire skewed onto the middle of the wedge-base extending across the body of the vent tube. Realignment occurs when the wire guide interferes with the filament wire and pushes it back to its proper mating position. Alignment of skewed filament wires protruding toward the exterior edge of the side wing occurs by interference with the terminal base. This interference urges the skewed filament wire back to its proper mating position.

The wire guide in some cases cannot reach extremely skewed filament wires and the terminal base cannot align skewed filament wires to the extreme outer edge of the side wing. Because of these extremely skewed filament wires, a wedge-base bulb might light intermittently or possibly not at all and a costly manual realignment of the filament wires becomes necessary.

The preferred embodiment urges better electrical contact upon installation. The subject invention provides a wire guide which wipes onto and not near the surface of the vent tube urging better alignment for even extremely skewed filament wires onto the vent tube.

The subject invention also provides a redundant contact terminal means whereby a skewed filament wire, not properly aligned by the improved wire guide or the terminal base, will still be urged to make proper electrical contact by providing a second contact surface in the interior of the terminal channel.

Previously designed snap-in lamp terminals were restricted in their utility because they could not be molded into vinyl without costly manufacturing provisions to prevent the vinyl mold fill from leaking into the terminal channel and insulating the electrical contact arms. The preferred embodiment remedies this problem by providing a wall in the rear of the terminal which will stop the flow of the vinyl mold fill into the interior of the terminal channel. This provision allows the preferred embodiment to be molded directly into the vinyl socket providing a less costly water resilient vinyl socket.

It is, therefore, an object of the invention to provide a snap-in lamp terminal for wedge-base bulbs with improvements in the wire guide design to urge proper alignment of the filament wires of the bulb which may be skewed onto the central vent tube.

Another object of the invention is to provide a redundant contact terminal means to urge proper electrical contact should the terminal base or the improved wire guide fail to realign the filament wire to its proper mating position. This redundant contact terminal means is demonstrated in the invention showing the snap-in lamp terminal incorporating four different structures of the redundant contact terminal means.

Still another object of the invention is to incorporate a mold fill retention wall in the rear of the terminal so that the snap-in lamp terminal can be used with a soft vinyl filled socket without flow of the mold material into the interior of the terminal.

These and other objects and advantages of the snap-in lamp terminal with redundant contact terminal means, improved wire guide and mold fill retention wall will become apparent from the following Detailed Description of the Preferred Embodiment, Drawings and Claims.

This application is one of six applications filed on July 3, 1985, all commonly assigned and having substantially the same Specification and Drawings, the six applications being identified below:

| U.S. Serial Number | Title |
|---|---|
| 061751,756 | Snap-In Terminal With Wire Guide |
| 061752,264 | Cantilevered Redundant Terminal |
| 061752,328 | Tab Redundant Terminal |
| 061752,265 | Folded Redundant Terminal |
| 061752,411 | Base Redundant Terminal |
| 061752,202 | Mold Fill Retention Wall For Snap-In Terminal |

DESCRIPTION OF THE DRAWINGS

Other objects, features and advantages of the present invention will become more fully apparent from the following Detailed Description of the Preferred Embodiment, the appended claims and in the accompanying drawings in which:

FIG. 4 is a sectional view through FIG. 3 illustrating the wedge-base bulb in position, and in communication with the snap-in terminal, the wire guide means, and redundant terminal means;

FIG. 5 is a sectional view illustrating the bulb retention features of the snap-in terminal as well as the cantilevered redundant terminal in communication with the filament wires;

FIG. 6 is a sectional end view illustrating the wiping action of the wire guide means;

FIG. 7 is a plan view of the snap-in terminal with cantilever redundant terminal means;

FIG. 8 is a side view of the subject terminal;

FIG. 9 is an end view of the subject terminal;

FIG. 10 is a perspective view of a snap-in terminal with cantilever redundant terminal means;

DETAILED DESCRIPTION OF THE PREFERRED EMBODIMENT

Figure 1:
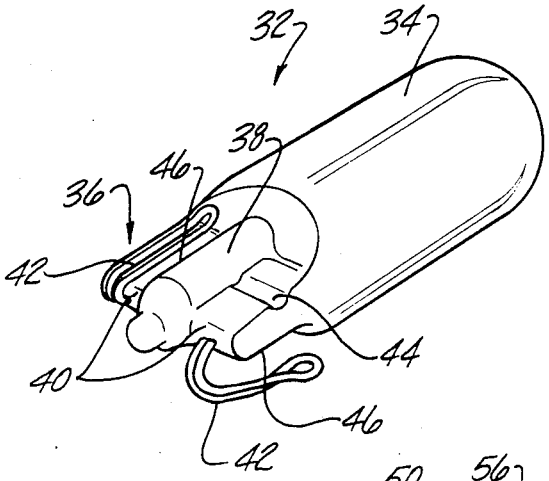
FIG. 1 is a perspective view of a typical wedge-base bulb or lamp which is inserted into the socket-terminal assembly described herein.

Referring to FIG. 1, a wedge-base bulb typical of the bulbs or lamp utilized in the subject invention in an automotive environment is illustrated along with its filament wires. The wedge-base bulb 32 consists of a bulbular evacuated chamber 34, a wedge-base 36 and a vent tube 38.

The vent tube 38 is a cylindrical shape and centrally located on wedge-base 36 in the longitudinal axis of bulbular evacuated chamber 34. The centrally located cylindrically shaped vent tube 38 separates two side wings 40 of the wedge base.

The side wings 40 encapsulate the filament wires 42 and also have a concave detent trough 44. The troughs 44 are perpendicular to the vent tube 38.

The filament wires 42 extend out from the end of the side wings and are bent along the face of the side wings in the longitudinal axis of the bulbular evacuated chamber 34. The filament wires are bent along the flat surface 46 of the side wings. The flat surface 46 is opposite the side wing surface carrying the concave detent trough 44.

Figure 2:
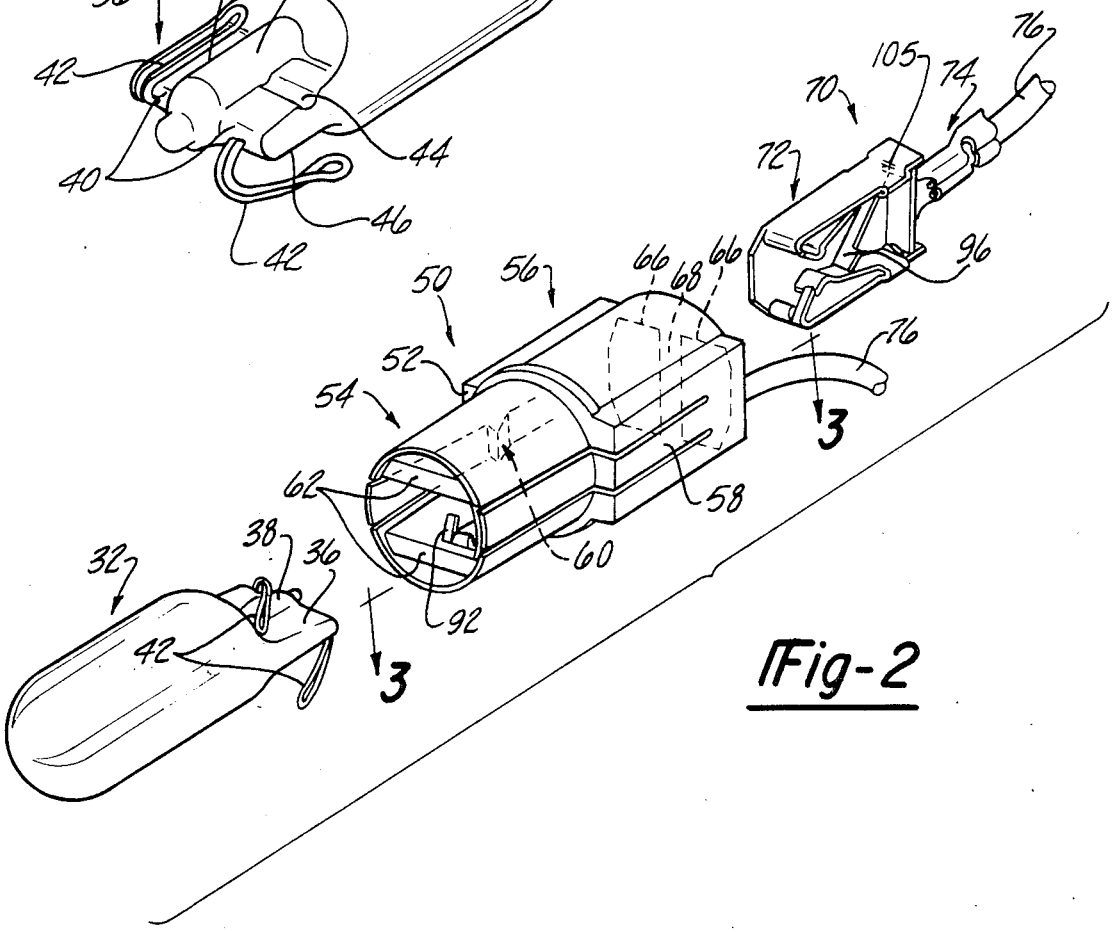
FIG. 2 is a perspective-exploded view showing the wedge-base bulb, the socket housing and snap-in terminal.

Referring now to FIG. 2, the wedge-base bulb 32 is shown in perspective with socket 50 and snap-in terminal 70.

Socket 50 is generally of tubular construction and shape and comprises a bulb housing section 54 and a terminal axis chamber 56. Also included in this particular socket embodiment is rim 52 which is designed as a stop for panel mounted bulbs. The bulb housing 54 is of cylindrical shape.

The terminal access chamber 56 is also generally cylindrically shaped and is designed to accept a pair of terminals 70.

Figure 3:
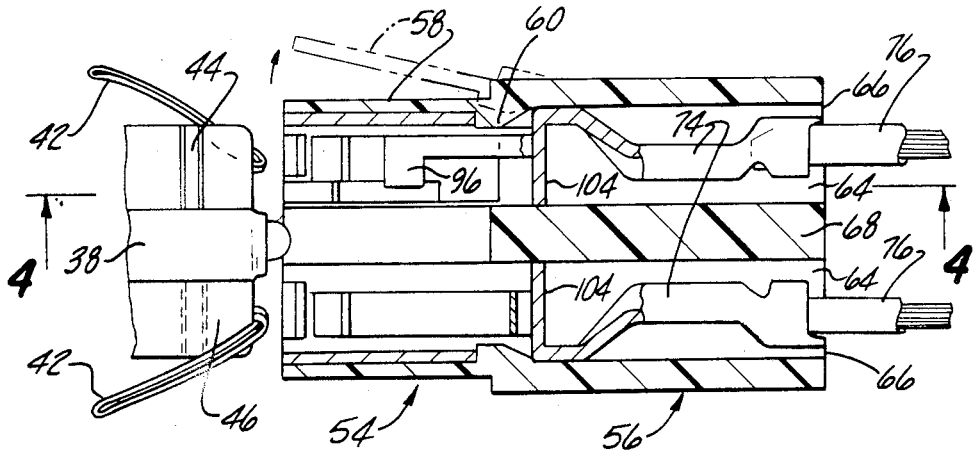
FIG. 3 is a sectional view through the housing shown in FIG. 2 with the snap-in terminal shown in place and the wedge-base bulb in position to be inserted.

Terminal guides 64, shown in FIG. 3, are slotted through terminal access chamber 56 and bulb housing 54 terminating in end stop 62. The snap-in terminal 70 is inserted into the terminal access chamber 56 through terminal guide ports 66. The terminal guide ports 66 are separated by terminal guide center posts 68.

Also provided in tubular socket 50 are wedge clamps 58. The purpose of these wedge clamps is to communicate with the snap-in terminal 70 and lock it in place. This occurs via wedge member 60 shown in FIG. 3 which is attached to the interior of wedge clamp 58.

Wedge clamp 58 is cantilevered onto the housing assembly such that the portion at the end of bulb housing 54 when pulled will move outboard of housing 50 being hinged on terminal access chamber 56 thereby pulling wedge member 60 out of communication with terminal 70 and releasing terminal 70 from the socket 50. The wedge 60 communicates with the wedge receiving slot 82, shown in FIG. 10, provided in snap-in terminal 70.

Referring now to FIG. 10, as well as FIG. 2, the snap-in terminal 70 comprises a lamp receiving portion 72 and a conduit receiving portion 74. The conduit receiving portion 74 communicates with conduit 76 via crimped wire retention flanges 78 and provides sufficient physical and electrical connection to snap-in terminal 70.

The lamp receiving portion 72 is generally a channelized part comprising a terminal base 80 and terminal sides 84. The terminal base 80 provides the previously mentioned wedge receiving slot 82 and forms the base from which terminal sides 84 are formed.

Cantilevered from terminal sides 84 on the interior side of the channel are contact arms 86 and 88. The contact arms 86 and 88 are formed by a folding action resulting in tabs 89. On each contact arm 86 and 88 are concave spring contacts 90. The purpose of the contacts 90 are to communicate with the filament wires 42 or the concave detent troughs 44.

Formed from the bulb end of one of the terminal sides 84 is wire guide means 92. The purpose of the wire guide means is to communicate with filament wires 42 which may be skewed along vent tube 38. The communication between the wire guide means 92 and the filament wires 42 is the result of the wiping action of the wire guide means 92 along the vent tube 38. At the end of this wiping action, the filament wire 42, if skewed along the vent tube 38, should now be in proper mounting position in the longitudinal axis of bulbular evacuated chamber 34. The interaction between the filament wire 42 as supported by side wing 40 and wire guide means 92 results in the deformation of wire guide means 92.

Also provided at the bulb end of the terminal sides 84 are bulb guides 94 which are rounded tabs to guide the side wings 40 into communication with the contact arms 86 and 88.

The contact arms 86 and 88 are cantilevered into the interior of the channelized portion of the snap-in terminal 72 to provide a spring biased retention force on the wedge-base bulb 32 by engaging the concave detent troughs 44 via concave spring contacts 90 and by engaging filament wires 42 with concave spring contacts 90.

Alignment of skewed filament wires 42 protruding toward the exterior edge of the side wing 40 are urged toward proper alignment through interference with the terminal base 80.

Also shown in FIGS. 2 and 10 is the preferred embodiment of the redundant terminal means which is designed to make electrical contact with filament wires 42 which are skewed onto the sides of side wings 40 or out of reach of the wire guide 92 and not aligned by interference with base 80. The redundant terminal means illustrated in FIGS. 2 and 10 is shown as cantilevered redundant terminal 96. This cantilevered redundant terminal 96 is formed from the folded tab 89 on the contact arm 86 which is designed to communicate with concave detent trough 44. The cantilevered redundant terminal 96 is positioned in the interior of the generally channelized lamp receiving portion 72 and is directed toward contact arm 88 which is designed to communicate with filament wire 42.

FIG. 4 is a sectional view through FIG. 3 illustrating the wedge-base bulb in position, and in communication with the snap-in terminal, the wire guide means, and redundant terminal means. FIG. 5 is a sectional view illustrating the bulb retention features of the snap-in terminal as well as the cantilevered redundant terminal in communication with the filament wires. FIG. 6 is a sectional end view illustrating the wiping action of the wire guide means. FIG. 7 is a plan view of the snap-in terminal with cantilever redundant terminal means. FIG. 8 is a side view of the subject terminal. FIG. 9 is an end view of the subject terminal.

Figure 11:
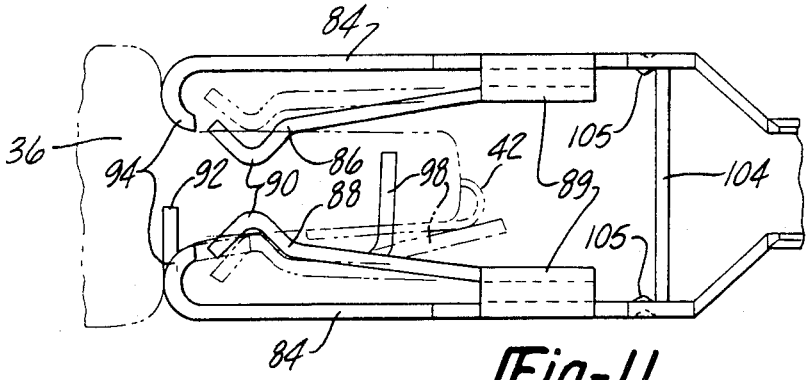
FIG. 11 is a plan view of the subject terminal illustrating a tab redundant terminal.
Figure 12:
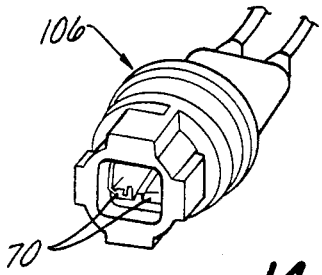
FIG. 12 is a perspective view showing a vinyl fill molded socket for the subject terminal.

Another version of the redundant terminal means is illustrated in FIG. 11 and is shown as tab redundant terminal 98. The tab redundant terminal 98 is notched out from contact arm 88 which is the contact arm designed to communicate with the filament wire 42.

Figure 16:
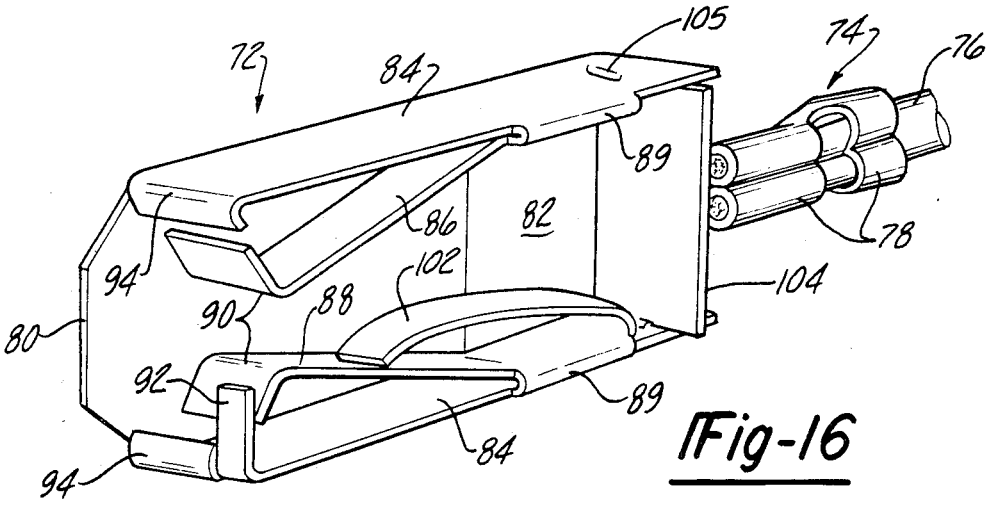
FIG. 16 is a perspective view showing the folded redundant terminal in the subject snap-in terminal.

Still another version of the redundant terminal means is shown in FIG. 16 as folded redundant terminal 102. Again, this folded redundant terminal 102 is formed from the contact arm 88 which is designed to communicate with filament wire 42. It is formed from folded tab 89 and bent back along contact arm 88 in the same longitudinal direction.

Figure 17:
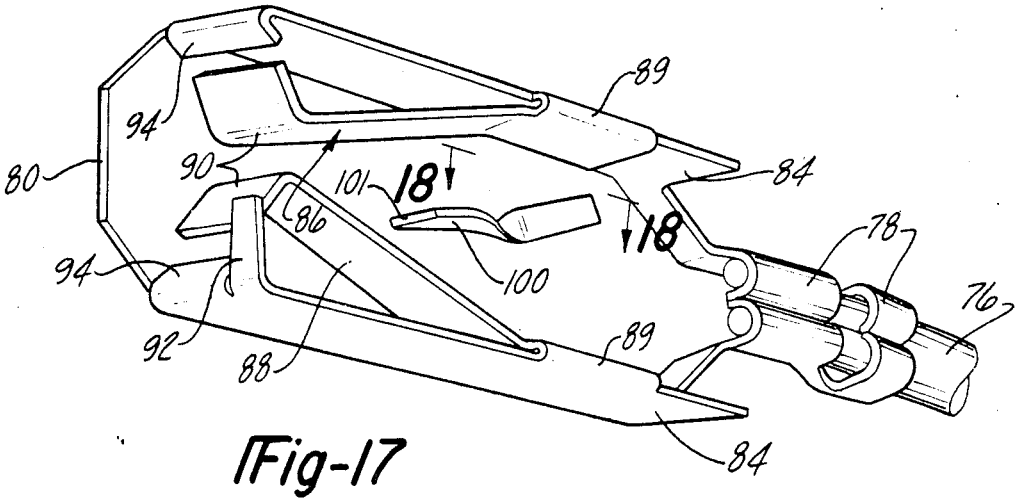
FIG. 17 is a perspective view showing the base redundant terminal in the subject snap-in terminal.

Still another redundant terminal means is illustrated in FIG. 17 and is shown as the base redundant terminal 100. The base redundant terminal 100 is designed for use with snap-in terminals which fit into sockets that do not require wedge receiving slots 82. The base redundant terminal 100 is notched up from the terminal base 80 into the interior of the generally channelized lamp receiving portion 72. The base redundant terminal 100, in addition to being positioned into the interior of the generally channelized lamp receiving portion 72 is also directed toward the contact arm 88 which is designed to communicate with the filament wires 42.

Figure 18:
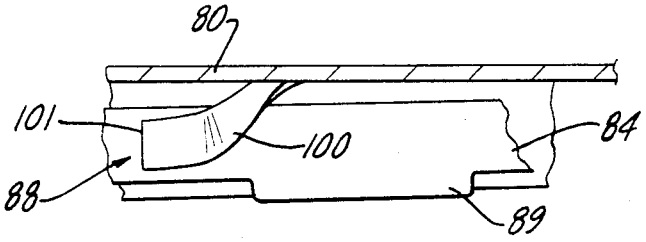
FIG. 18 is a side sectional view of the base redundant terminal shown in the subject snap-in terminal.

The end of base redundant terminal 100, shown as 101 in FIG. 17, is a twisted tang member designed to make contact with skewed filament wires 42 which are outboard of the side wings 40. This is also illustrated in side sectional view in FIG. 18.

The snap-in terminal 70 has another feature which is designed to be used with mold filled sockets 106 shown in FIGS. 12 through 15. The mold filling socket 106 is shown in perspective view in FIG. 12 with a pair of snap-in terminals 70 in place. FIG. 4 is a sectional view through FIG. 3 illustrating the wedge-base bulb in position, and in communication with the snap-in terminal, the wire guide means, and redundant terminal means. FIG. 5 is a sectional view illustrating the bulb retention features of the snap-in terminal as well as the cantilevered redundant terminal in communication with the filament wires. FIG. 6 is a sectional end view illustrating the wiping action of the wire guide means. FIG. 7 is a plan view of the snap-in terminal with cantilever redundant terminal means. FIG. 8 is a side view of the subject terminal. FIG. 9 is an end view of the subject terminal.

Figure 13:
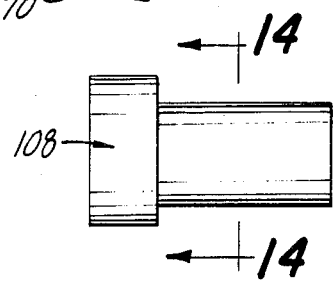
FIG. 13 is a sectional view illustrating the molded socket, snap-in terminal and core assembly tool.
Figure 14:
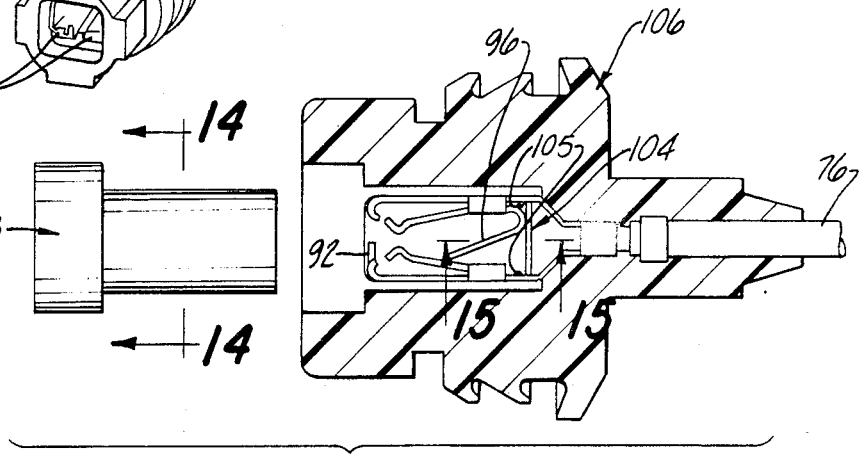
FIG. 14 is a sectional end view of the core tool.
Figure 14:
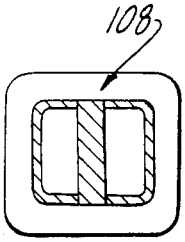
Figure 15:
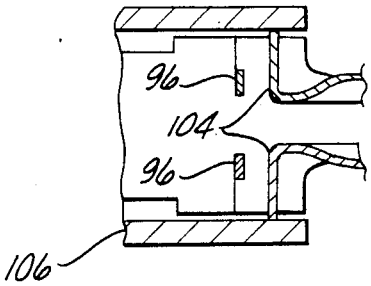
FIG. 15 is a detailed section illustrating the mold fill retention wall and a pair of terminals in place.

Shown in FIG. 13 is a core tool 108 which is inserted around the snap-in terminal assembly 70 in the mold (not shown) prior to vinyl fill operations. The vinyl is shot into the mold around the core tool 108 and the snap-in terminal assembly 70 thereby encapsulating the terminal and conduit 76. The encapsulation provides a strong strain relief function for the conduit 76, as well as a moisture sealing function.

Attention is now invited to mold fill retention wall 104 on snap-in terminal 70 in FIGS. 11, 13, 15, 16. The mold fill retention wall 104 communicates with the core tool 108 and the mold to prevent the flow of vinyl fill material into the generally channelized lamp receiving portion 72 of snap-in terminal 70. The mold fill retention wall 104 communicates with tabs 105 to seal the generally channelized lamp receiving portion 72 from excess vinyl fill material and flash in the fill process. Without the mold fill retention wall 104 and tabs 105, molded vinyl fill sockets would be much more expensive to make and the vinyl fill material would likely flow into the generally channelized lamp receiving portion 72 thereby interfering with the insertion of the wedge-base bulb 32 or the electrical contact of filament wires 42 with the snap-in terminal 70 or the communication of the concave detent troughs 42 with the concave spring contacts 90.

While the present invention has been disclosed in connection with the preferred embodiment thereof, it should be understood that there may be other embodiments which fall within the spirit and scope of the invention and that the invention is susceptible to modification, variation and change without departing from the proper scope and fair meaning of the following claims.

I claim:

1. A snap-in lamp terminal for use in a socket housing for receiving, locating and positioning a wedge-base bulb having a pair of filament extension wires positioned on sides of the wedge base, a pair of troughs extending transverse to the wedge base, the wedge base further having a centrally located cylindrical vent tube and a bulbular evacuated chamber both in the same longitudinal axis, the vent tube bounded by laterally extending side wings of the wedge base, the snap-in terminal comprising:

a lamp receiving portion and a conduit receiving portion;

the conduit receiving portion including wire retention means;

the lamp receiving portion of a generally channelized shape having a terminal base and terminal sides forming the channel;

cantilevered contact arms projecting into the interior of the generally channelized lamp receiving portion from the terminal side via folded tabs;

the contact arms including spring contact members for communication with the detent troughs of the bulb and filament wires of the bulb;

the terminal sides having curved bulb guides at the lamp receiving end to communicate with the wedge-base bulb;

a wire guide means projecting into the interior of the generally channelized lamp receiving portion from one of the terminal sides such that a wiping action will occur when the wedge-base bulb is inserted into the terminal whereby the wire guide means wipes along the vent tube of the bulb thereby straightening any skewed portion of the filament wires; and the redundant terminal means comprising a base redundant terminal notched outward from the terminal base toward the interior of the generally channelized lamp receiving portion of the snap-in terminal and directed toward the contact arm designed to make contact with the filament wires.

2. The snap-in terminal with base redundant terminal of claim 1 further comprising a twisted end forming a tang to urge contact between the filament wires and the snap-in terminal.

* * * * *